US005245998A

United States Patent [19]

Sundsrud et al.

[11] Patent Number: 5,245,998

[45] Date of Patent: Sep. 21, 1993

[54] HUMIDITY CONCENTRATING TENT

[75] Inventors: Larry A. Sundsrud, Park Rapids, Minn.; Robert J. Rose, Lyme, N.H.

[73] Assignee: PEP, Inc., Park Rapids, Minn.

[21] Appl. No.: 792,906

[22] Filed: Nov. 15, 1991

[51] Int. Cl.[5] ..... A61G 10/00

[52] U.S. Cl. ..... 128/205.26; 128/200.24

[58] Field of Search ..... 128/202.12, 205.26, 128/200.24; 600/22, 21; 4/527, 534, 536

[56] References Cited

U.S. PATENT DOCUMENTS

| | | | |
|---|---|---|---|
| 1,491,089 | 4/1924 | Erdosy | 4/534 |
| 2,401,605 | 6/1946 | Boren | 600/22 |
| 2,526,357 | 10/1950 | Hjelm | 4/536 |
| 2,847,006 | 8/1958 | Griffith | 128/205.26 |
| 3,196,871 | 7/1965 | Hormats et al. | 128/205.26 |
| 3,318,308 | 5/1967 | Grosholz | 128/205.26 |
| 3,540,446 | 11/1970 | Dixon | 128/205.26 |
| 3,639,930 | 2/1972 | Miller | 5/330 |
| 3,703,173 | 11/1972 | Dixon | 128/205.26 |
| 3,878,570 | 4/1975 | Donnelly | 5/97 |
| 3,905,056 | 9/1975 | Rosendahl | 5/97 |
| 4,026,286 | 5/1977 | Trexler | 600/22 |
| 4,444,183 | 4/1984 | Heckerdorn | 128/205.26 |
| 4,491,141 | 1/1985 | Eppenbach | 135/104 |
| 4,641,387 | 2/1987 | Bondy et al. | 5/508 |

*Primary Examiner*—Edgar S. Burr
*Assistant Examiner*—Aaron J. Lewis

[57] ABSTRACT

A treatment system includes a vaporizer, a tent for maintaining a high humidity environment in a chamber around at least the upper body of an individual under treatment, and a flexible conduit from the vaporizer to the chamber. The tent includes a supporting framework and a porous fabric supported by the framework. The fabric, preferably a polyester tricot, consists of multifilament strands woven to provide a porosity of about fifty percent. So constructed, the fabric is air permeable, yet tends to block a substantial percentage of moisture droplets suspended in the air, thereby increasing the relative humidity inside the therapy tent to a value substantially above ambient relative humidity, for example over ninety percent while ambient levels outside the tent remain at about fifty percent. As a result, a therapeutic, high humidity environment is maintained about the patient, without the need for oxygen supplies, pumps, blowers or other special equipment. Thus, treatment is provided at substantially lower cost and at less risk to the patient.

25 Claims, 3 Drawing Sheets

Fig.-3
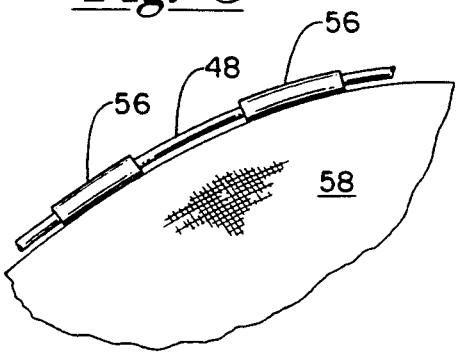
Fig.-5
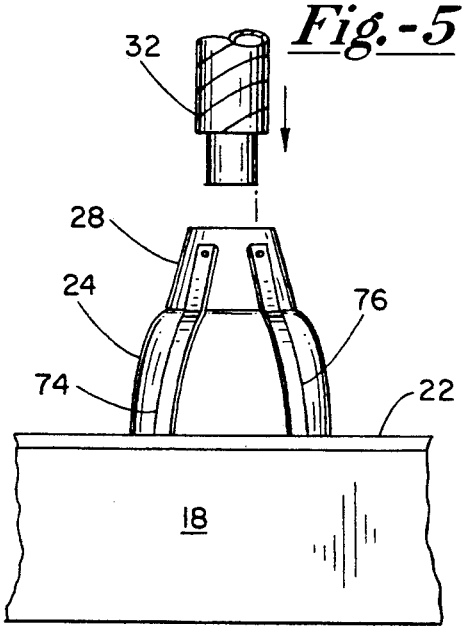
Fig.-4
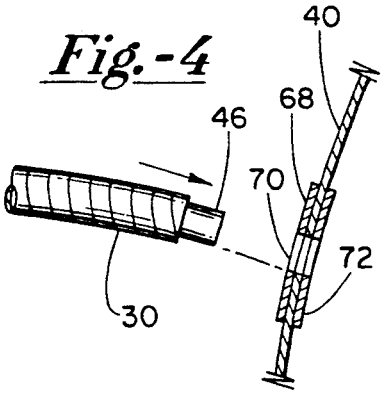
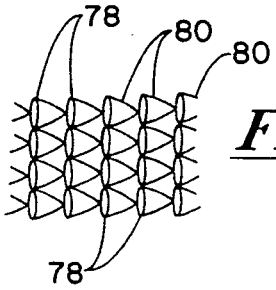
Fig.-6

HUMIDITY CONCENTRATING TENT

BACKGROUND OF THE INVENTION

The present invention relates to means for controlling environments in medical treatment applications, and more particularly to an enclosure for maintaining high relative humidity and sufficient oxygen in the region about a patient's head and upper body.

Nebulized vapor or mist is widely recognized as an effective therapy to alleviate the symptoms of croupe, asthma and upper respiratory diseases in general. Devices for providing moist air therapy are available for hospital and household settings. In hospitals, the typical approach is to employ an oxygen tent constructed of flexible, pliable and transparent plastic sheeting or film, draped over a bed to form an enclosure surrounding at least the upper body of the patient. Oxygen is supplied to the tent interior, usually at a controlled, steady rate. The oxygen or air supplied to the tent can be humidified to the extent desired. These systems are expensive, however, and require physicians, nurses or other skilled personnel to monitor conditions within the oxygen tent to insure the safety and comfort of the patient.

Moist air treatment devices have been developed for household use. Such devices are substantially less expensive and require less skill to operate and monitor as compared to a hospital oxygen tent, although they do not afford the same degree of environmental control. Examples of these devices include cool mist vaporizers, warm mist vaporizers (sometimes referred to as "steamers") and ultrasonic vaporizers. Typically such vaporizers generate a stream of moist air in the form of multiple suspended droplets in the range of about three to five micrometers in diameter. The effectiveness of these devices depend substantially on the degree to which the moist air stream can be directed toward the nose and mouth of the patient. Further, the devices tend to increase the relative humidity of the entire room in which the patient is situated. Humidity sufficiently high to treat the patient can be a source of discomfort to others, and has undesired consequences, e.g. promoting the growth of molds that thrive in humid environments.

One approach to containing a treatment environment in a household setting is shown in U.S. Pat. No. 3,878,570 (Donnelly). The Donnelly patent discloses a crib attachment including a detachable frame and a flexible canopy supported by the frame over the crib to enclose the crib in a semi-airtight manner. The canopy is preferably transparent. An environmental control apparatus mounted to the crib includes a blower for drawing room air, an air filter, a heater, and a damp sponge for humidifying the air. A flexible hose supplies the filtered, heated and humidified air to the tent interior.

U.S. Pat. No. 3,905,056 (Rosendahl) discloses a mist-oxygen therapy crib liner tent including a bottom situated under a crib mattress, and four side panels extending upwardly from the bottom panel along the sides of the crib. The tent can be placed, inverted, over a conventional therapy tent frame, and a opening cut out of the bottom (top in the inverted position) to provide a mist-oxygen enclosure. In U.S. Pat. No. 4,641,387 (Bondy et al), plastic sheet material and cooperating netting are employed to form transparent panels about the top, opposed sides and opposed ends of a bed, to provide what is said to be a bed enclosure which is not mentally or physically intimidating to the patient.

While each of the above devices is perhaps useful in certain situations, there remains a need for a low cost, safe and effective means for providing a confined, high humidity treatment enclosure for household use.

Therefore, it is an object of the present invention to provide a means for developing and sustaining a high humidity environment about an individual for respiratory therapy, without the need for an oxygen supply, pump, blower or other special equipment.

Another object of the invention is to provide an enclosure that effectively confines a high humidity environment to the region about an individual under treatment, while insuring an adequate oxygen supply and preventing accumulation of carbon dioxide.

Yet another object is to provide a system employing a conventional household vaporizer to maintain a controlled, high humidity treatment environment in the region of an individual's head and upper body.

SUMMARY OF THE INVENTION

To achieve these and other objects, there is provided a humidity retaining enclosure. The enclosure includes a flexible and pliable sheet of porous material, permeable to air. The enclosure further includes a frame means positionable on a substantially horizontal surface. The frame means supports the sheet with respect to the horizontal surface, with the sheet and the horizontal surface cooperating to form a substantially enclosed chamber. An inlet port is provided in the sheet for receiving air and suspended moisture droplets into the chamber from a moist air source. The sheet tends to confine a substantial proportion of the suspended droplets in the chamber.

Preferably the porous material is a tightly woven fabric, more preferably a tricot of either nylon or polyester. Further, the material porosity, in terms of the combined surface area of the pores as compared to the total surface area of the sheet in the profile, is in the range of from about forty to about sixty percent, and more preferably at about fifty percent. In other words, the occlusion of the sheet material is about fifty percent.

The moist air source can be a common household nebulizing or vaporizing device, with a flexible conduit providing a passageway from the nebulizing device to the chamber. To this end, a corrugated hose can be employed in connection with an adapter mounted to the nebulizing device and surrounding a moist air output of the nebulizing device. The adapter can provide a releasable, coaxial slip fit with one end of the corrugated hose.

To accommodate the other end of the hose, a fitting is provided at the inlet port. More particularly, an annular layer of reinforcing material is attached to each side of the sheet surrounding the inlet port, to form an annular coupling attached to the reinforcing layer. The coupling receives one end of the corrugated hose in a releasable, coaxial slip fit. Thus, at each end the hose is connected in an easily established and released, substantially fluid tight coupling.

The strands forming the weave are about five mils in diameter, and the pores, while irregular, have transverse dimensions on the same order, ranging from about one mil to about ten mils. This provides the desired occlusion of about fifty percent. Further, while the individual strands can be monofilament or multiple filaments, they are preferably transparent, translucent or at least of light (preferably white) color. The resulting sheet material is then substantially transparent, permitting observation of the individual undergoing treatment, and minimizing any confined or claustrophobic feelings on the part of the individual.

In connection with the enclosure, the nebulizing device is operated in the usual fashion, the sole difference being that air laden with droplets is supplied to the chamber rather than to the room at large. The relative humidity in the chamber increases, due to a combination of factors including the tendency of the sheet material to block a substantial number of the droplets (at least fifty percent) from leaving the chamber, the tendency of droplets to collide with one another within the chamber and form larger droplets, and the tendency of water vapor and droplets to combine at a rate that increases with the relative humidity. Moisture condensation on the inside surface of the fabric tends to increase the occlusion of the fabric, further increasing the percentage of droplets retained in the chamber. Eventually a steady state condition is achieved, at which the relative humidity stabilizes at a level substantially higher than ambient relative humidity. More particularly, the relative humidity tends to stabilize at values slightly greater than ninety percent, thus to provide effective treatment, yet avoid a fogging tendency in non-porous plastic humidity tents, that requires occasional lifting of a tent flap to release moisture from inside the tent.

During the increase and subsequent stabilization in relative humidity, oxygen and carbon dioxide remain entirely free to pass into and out of the chamber through the sheet fabric. Thus, an adequate supply of oxygen is maintained within the chamber and undue buildup of carbon dioxide is prevented, without pressurized oxygen supplies, intake and exhaust fans, or similar equipment. Elimination of the need for this equipment of course eliminates the risk of harm to the patient due to failure of such equipment.

One convenient frame means includes two arched frame members having their respective ends near the horizontal surface and intersecting one another at their midpoints remote from the horizontal surface. So arranged, the frame members support the sheet in a dome configuration over the horizontal surface.

Thus, in accordance with the present invention a safe, low cost and convenient approach is provided for maintaining a high humidity atmosphere around an individual, e.g. completely surrounding the individual in the case of an infant reclining in a crib, or restricted to the area of the head and upper body of an adult reclining on a bed. The high humidity is effectively confined to the desired treatment area, avoiding discomfort to persons near the patient. At the same time, adequate air exchange is maintained strictly due to the permeability of the enclosure, for convenient operation and patient safety.

IN THE DRAWINGS

For a further appreciation of the above and other features and advantages, reference is made to the following detailed description and to the drawings, in which:

FIG. 3 is an enlarged elevation of a portion of the tent;

FIG. 4 is an enlarged view of a conduit end region and a portion of the tent;

FIG. 5 is an elevational view showing part of a nebulizing device of the system and another end of the conduit;

FIG. 6 is an enlarged view of a fabric wall portion of the tent;

Figure 7:
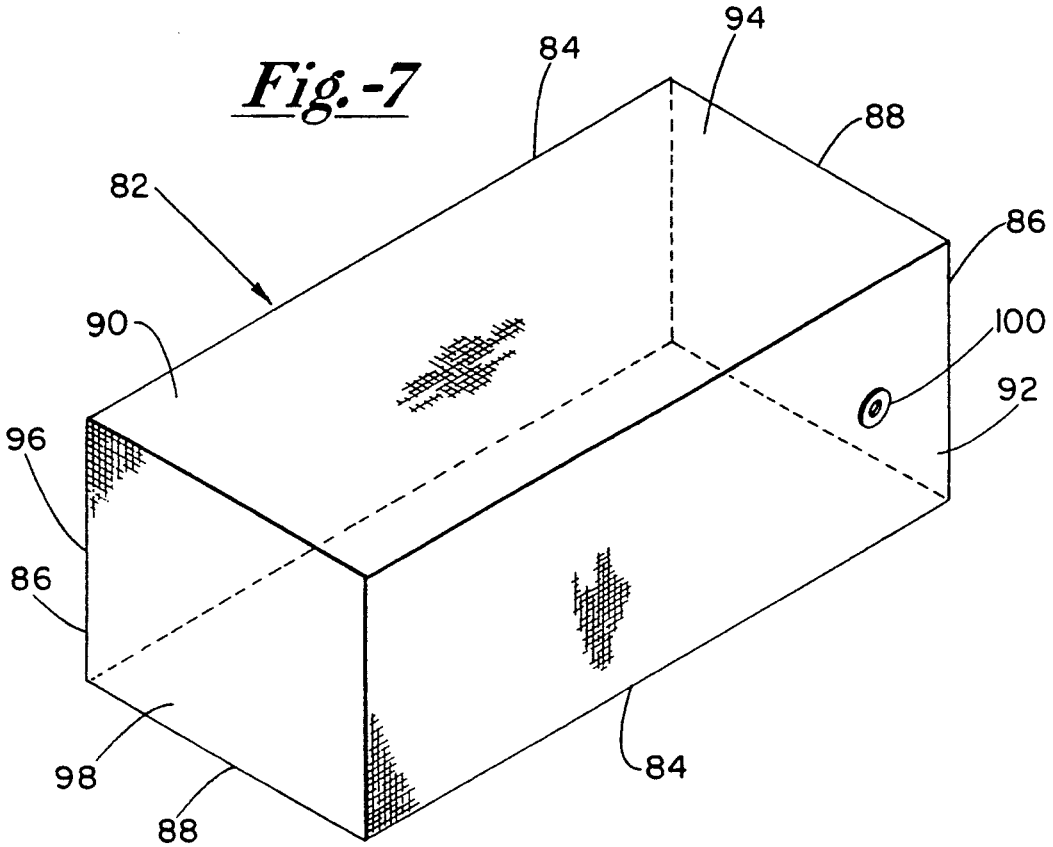
Figure 8:
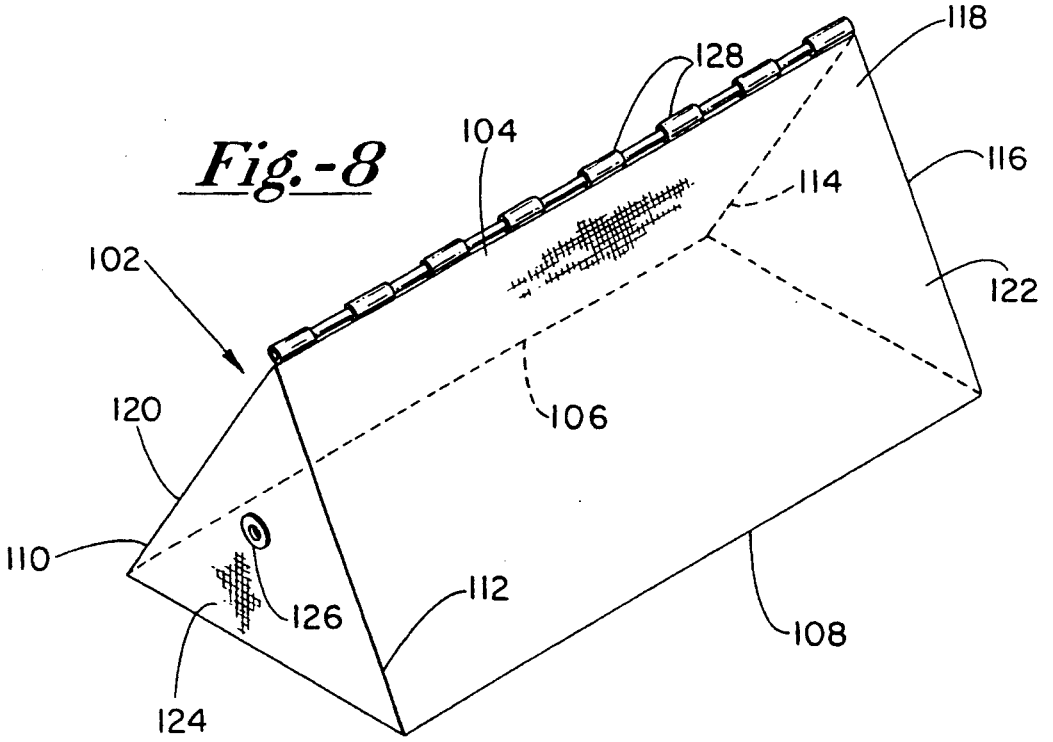

FIG. 7 a perspective view of an alternative embodiment humidity concentrating tent; and FIG. 8 is a perspective view of a further embodiment humidity concentrating tent.

DETAILED DESCRIPTION OF THE PREFERRED EMBODIMENTS

Figure 1:
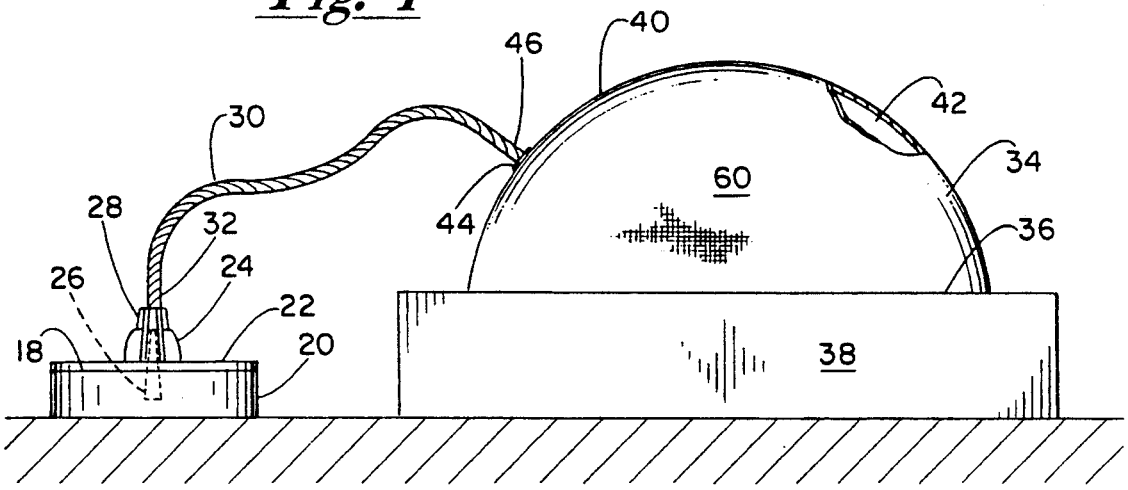
FIG. 1 is an elevation of a humid air treatment system constructed according to the present invention.

Turning now to the drawings, there is shown in FIG. 1 a treatment system 16 for providing a high humidity environment to a patient, more particularly in the region of the head and upper body. In general, the system includes means for generating a supply of moist air including nebulized water and water vapor, an enclosure for confining the moisture in an intended treatment region about the patient, and a means for transporting the moist air from the nebulizing device to the chamber.

The nebulizing device is a spin type cool mist vaporizer 18. Vaporizer 18 includes a basin 20 for containing water and a removable cover 22 including a central dome 24. An impeller 26, centered within the dome and basin, is rotatable to draw water from the basin, combine the water with air drawn into the vaporizer through passages in dome 24, then propel the air and water upwardly out of the vaporizer, through an opening in the top of the dome. Typically the moisture takes the form of a mist including multiple droplets, each with a diameter of about five microns.

One example of a suitable nebulizing device is a vaporizer sold under the brand name Hankscraft. However, it should be noted that other devices can be employed, for example ultrasonic vaporizers or warm mist vaporizers. In general, these devices provide moist air including a mist of droplets in the range of from about three to about five micrometers in diameter.

An adapter 28 is mounted to the top of dome 24 to facilitate the coupling of a corrugated, flexible hose 30 to receive the vaporizer output. More particularly, an inlet end 32 of the hose is concentrically and releasably engaged with adapter 28.

Hose 30 provides a conduit for moist air from vaporizer 18 to a humidity concentrating tent 34 on a top surface 36 of a bed 38, or any other suitable, preferably horizontal surface upon which a patient can recline. The tent has a fabric wall 40 which cooperates with horizontal surface 36 to form an enclosed chamber 42. A fitting 44, mounted to the wall, surrounds an opening to the chamber and is releasably coupled to an outlet end 46 of hose 30. Accordingly, moist air generated by vaporizer 18 is provided to chamber 42 through the hose.

Figure 2:
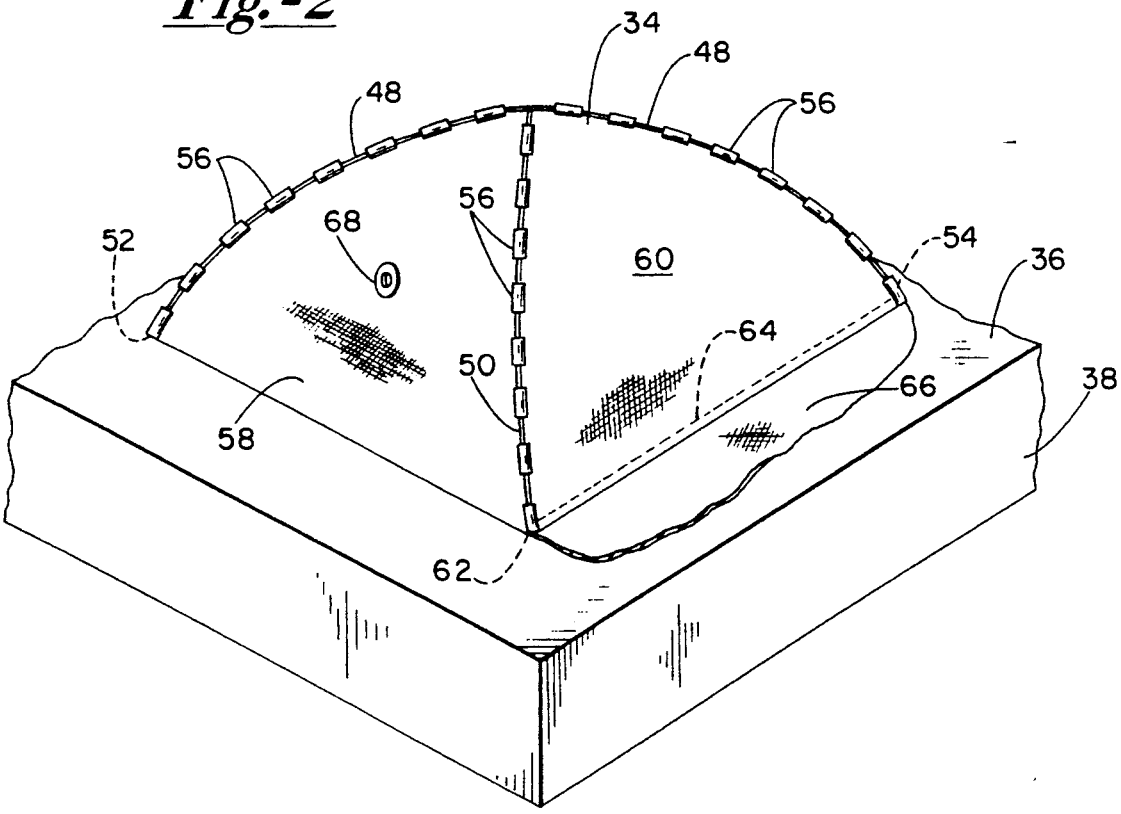
FIG. 2 is a perspective view of a humidity retaining tent forming part of the system.

FIG. 2 shows tent 34 in greater detail. A framework for supporting the tent includes two elongate rods 48 and 50. Each of the rods is normally straight, and elastically formed into an arch supported by horizontal surface 36 at its opposite ends, as indicated at 52 and 54 with respect to rod 48. Rod 50 intersects rod 48 at about a ninety degree angle at midpoints of both rods. A series of loops 56, formed of the same fabric that forms wall 40, are secured to the wall and surround rods 48 and 50. Each loop is sewn to the fabric forming the tent wall. Rods 48 and 50 are then threaded through successive loops whereby the fabric wall is suspended from the rods, as illustrated in FIG. 3 in connection with rod 48. The fabric forming the walls is flexible and pliable, and readily assumes the configuration in FIG. 2 including four somewhat rounded and somewhat triangular panels, two of which are indicated at 58 and 60.

In a suitable alternative arrangement (not shown), the fabric sheet can be positioned over rods 48 and 50, with the rods inside tent 34 and running along the inside surface of wall 40.

Wall 40 is preferably formed as a single sheet of fabric, and cooperates with rods 48 and 50 to maintain the desired shape of tent 34. More particularly, along three sides of the tent including panel 58 and the two panels not appearing in FIG. 2, the fabric is held in tension near surface 36 between end portions of the rods, e.g. between end 52 and an end 62 of rod 50 in connection with panel 58. Remaining panel 60 includes a strap 64 joined to rod ends 62 and 54, and thus the fabric need not be under tension between these rod ends. As a result, the fabric that forms panel 60 is secured only to one of rods 48 and 50, and draped over the other rod to provide a flap or door for access to chamber 42. Preferably the flap is somewhat oversized, as indicated at 66.

Fitting 44 is mounted to panel 58, preferably close to one of the support rods. As seen in FIG. 4, fitting 44 includes a substantially flat annular reinforcing layer 68 attached to the outside surface of tent wall 40, and surrounding an opening 70 through the wall. A similar layer 72 also surrounds opening 70, on the inside surface of the wall. Fitting 44 preferably is constructed of plastic, and mounted to tent wall 40 by an adhesive between layers 68 and 72. Fitting 44 (around opening 70) and conduit end 46 conform to one another in shape, and are sized to facilitate a frictional slip fit in which the conduit end nests within the fitting for a releasable connection.

As seen in FIG. 5, a plurality of straps, two of which are shown at 74 and 76, are fastened to adapter 28 in an arrangement around the adapter. Straps 74 and 76 are flexible plastic, and engage dome 24, thereby tending to align the adapter coaxially with the dome. Adapter 28 rests upon the dome, supported by gravity, and the straps tend to maintain the adapter in its coaxial relation to the dome and the vaporizer exit opening (not shown). Adapter 28 has an opening that conforms to conduit end 32 of hose 30, for receiving the conduit end in a nesting, frictional, slip fit and releasable engagement. Thus, adapter 28 affords a quick and convenient coupling and decoupling of hose 30 with virtually any standard household vaporizing device.

The fabric forming tent wall 40 is shown in detail in FIG. 6. The fabric preferably is a tricot of polyester. Polyester provides a desired combination of flexibility, durability and high tensile strength, along with low water absorption and good strength when wet. The weave shown in FIG. 6 is formed of 20 denier monofilament, 28 gauge strands, and includes parallel rows or series of elongate loops 78 (vertical as shown), and cross strands 80 forming zig zag patterns between adjacent rows of loops. The fabric weighs 0.8 ounces per square yard, and is available from New England Bias Binding Company of Boston, Mass., and designated as industry standard tricot. The multifilament strands are about five mils in diameter. Multiple irregular openings in the fabric include elliptical and triangular openings or pores, with dimensions ranging from about one mil to about ten mils. The strands are shown as black to facilitate illustration of the weave. In practice, it is preferable that the strands be white, another light color, or somewhat transparent to impart a high degree of transparency to tent wall 40. Transparency of the tent wall helps counteract undue close or claustrophobic feelings on the part of the individual being treated. To this same end, it also is desirable to construct tent 34 of sufficient size to accommodate at least the upper body and head of an adult, even though it is essential only to provide the moist environment about the face, to aid breathing.

Materials other than polyester, e.g. nylon, can be employed in forming tent wall 40. Likewise, various weaves other than the tricot shown in FIG. 6 can be utilized with satisfactory results. The strands forming the weave can be monofilament or multifilament, and could be dark in color, although light coloring is preferred.

A critical factor, however, appears to be the occlusion of the fabric, in terms of its tendency to prevent a substantial proportion of moisture droplets from passing through the tent wall. More particularly, with droplets traveling through the wall in a longitudinal direction, the occlusion can be considered in terms of the transverse profile presented by the material. The occlusion depends upon the diameter of the strands that form the weave, and the closeness of the weave. For example, in the above described preferred polyester tricot, the strands provide about one half of the surface area of the entire fabric surface area (both in terms of transverse profile), for an occlusion of about fifty percent. An occlusion in the range of forty to sixty percent is preferred.

In using the system, therapy tent 34 is positioned about the head and upper body of an individual being treated while the individual reclines on a bed or other suitable surface. Corrugated hose 30 is connected with tent 34 and vaporizer 18, and the vaporizer activated, thus to provide moist air under a positive pressure to chamber 42. The multiple pores in tent wall 40, having diameters in the range of 1-10 mils as noted above, are substantially larger than the 3-5 micron diameter mist droplets. Consequently, a substantial proportion of the mist droplets are able to exit the chamber through the tent wall. Air most importantly oxygen and carbon dioxide, pass freely through the wall into and out of chamber 42.

At the same time, tent wall 40 prevents a substantial proportion of the droplets from leaving chamber 42, which leads to a marked increase in the relative humidity in the chamber as compared to ambient air surrounding the treatment tent. More particularly, it was found that in a room having an ambient relative humidity of fifty percent, a vaporizer alone increased the relative humidity to about fifty-five percent. The same vaporizer, connected to a treatment tent according to the present invention, increased the relative humidity within the chamber to ninety-three percent, while the surrounding ambient relative humidity remained at about fifty percent.

It is believed that the occlusion of the treatment tend fabric is a critical factor in achieving the marked increase in relative humidity. Assuming a random distribution of droplets within a moist air stream, fabric with a fifty percent occlusion initially tends to allow about half of the droplets to exit the chamber while blocking the remaining half of the droplets. The blocked droplets tend to condense or collect along the inside surface of tent wall 40. Collected moisture and the fabric cooperate to provide a barrier that causes turbulent flow patterns or currents along the inside of the tent wall. The turbulent flow patterns retard convection out of therapy tent 34. Rather than passing directly out of chamber 42 through the tent wall, the droplets are channeled along the wall or inwardly away from the wall.

It is noted that conventional hospital oxygen tents, constructed of moisture impermeable materials such as plastic sheeting, likewise could receive the output of a vaporizer to substantially increase relative humidity within a such a tent. However, plastic enclosures are impermeable to air as well as moisture. In practice, a plastic enclosure requires a positive displacement compressor to exchange and condition air within the enclosure. More particularly, a blower supplies ambient air or a valve is connected to a pressurized oxygen supply to insure an adequate oxygen supply to the individual undergoing treatment. Conditioning of the air typically involves removal of heat produced by the nebulizing action of the vaporizer and by moisture condensation.

Accordingly, a salient feature of the present invention is that tent wall 40 is completely permeable to air, which insures adequate oxygen supply and depletion of carbon dioxide without any blowers, pumps, oxygen supplies or similar extraneous equipment. Similarly, the high degree of air exchange prevents undue build up of heat within chamber 42, whether due to the nebulizing action of vaporizer 18 or condensation along tent wall 40. Thus, no air conditioning equipment is required. Since no such extraneous equipment is required, there is no need for skilled personnel to adjust and continually monitor the performance of such equipment. The system of the present invention is fail safe in the sense that equipment failure (specifically the vaporizer) reduces relative humidity within chamber 42, but presents no risk of oxygen depletion or build up of carbon dioxide.

As noted above, fabric occlusion appears to be a key factor in performance. It has been found that a fabric having too close a weave (e.g. a bed sheet) provides too much occlusion. Moisture is collected and accumulates to substantially close off the chamber, leading to build up of heat and carbon dioxide. In effect, the multiple pores are sealed.

On the other hand, mosquito netting is too open a weave. While more than adequate air exchange is provided, the occlusion of mosquito netting is insufficient to retain any substantial proportion of mist droplets, and the humidity within the chamber is not substantially increased above ambient levels.

In short, tent wall 40 permits air exchange to avoid oxygen depletion and build up of carbon dioxide during treatment, yet sufficiently confines suspended droplets to provide an environment of high relative humidity for the individual under treatment. While the advantage to the patient is apparent, further advantages are provided for those in proximity of the individual. In a hospital setting, physicians and nurses are able to work in a relatively comfortable, low humidity environment as compared to the high humidity environment around the patient. In a household setting, family members likewise need not be subjected to the high relative humidity treatment environment.

FIG. 7 illustrates a rectangular humidity concentrating tent 82 that could be used in the system of FIG. 1 in lieu of tent 34. Tent 82 includes a substantially rigid framework consisting of four parallel side members 84, four vertical end members 86 and four horizontal end members 88. The fabric is stretched or otherwise supported between various frame members to provide a top panel 90 and four side panels 92, 94, 96 and 98, with an open bottom. Thus, the tent can be placed over an individual being treated, for example over an infant reclining in a crib. A fitting 100 on panel 92 includes annular layers sized for the outlet end of a corrugated hose.

FIG. 8 shows a triangular humidity concentrating tent 102, with a support structure including three horizontal frame members 104, 106 and 108, and inclined frame members 110, 112, 114 and 116. The frame members and a fabric tent wall 118 cooperate to form two inclined side panels 120 and 122, and an end panel 124 supporting a fitting 126 for a releasable connection to a conduit that supplies moist air. Tent wall 118 is suspended from horizontal member 104 by a series of loops 128 surrounding the member and secured to the fabric. At the end opposite from end panel 124, extra material can be draped over the supporting structure to provide a flap or doorway into the treatment tent interior. If desired, opposite inclined frame members can be mounted pivotally with respect to horizontal frame member 104, to allow a folding of side panel 120 against opposite side panel 122, for a relatively flat configuration to facilitate storage and transporting of treatment tent 102.

Regardless of the treatment tent configuration, the high porosity of the fabric, in combination with an occlusion factor that promotes air exchange yet tends to retain moisture, affords a high humidity environment confined to the individual under treatment, without the need for forced air, oxygen supplying equipment or apparatus to condition the air surrounding the individual.

What is claimed is:

1. A humidity retaining patient enclosure for use with a moist air source, including:

a flexible and pliable sheet of porous material having a porosity in the range of about forty percent to about sixty percent, and with multiple pores of the material being sufficiently large to permit free passage of air through the sheet;

a means forming an inlet port in the sheet for receiving moist air including multiple suspended droplets into the chamber from a moist air source, wherein the sheet tends to confine a substantial proportion of the suspended droplets in the chamber.

2. The enclosure of claim 1 wherein:

the porous material is a woven fabric.

3. The enclosure of claim 2 wherein:

the woven fabric is a tricot of either nylon or polyester.

4. The enclosure of claim 1 wherein:

the individual pores of the porous material have length and width dimensions in the range of from about one mil to about ten mils.

5. The enclosure of claim 4 wherein:

said porosity is about fifty percent.

6. The enclosure of claim 1 further including:

a first reinforcing layer attached to a portion of the sheet in surrounding relation to the inlet port.

7. The enclosure of claim 6 further including:

a second reinforcing layer attached to the reinforcing layer, surrounding the inlet port and on the opposite side of the sheet from the first reinforcing layer, and a flexible conduit providing a passageway for moist air and having a first conduit end adapted for a releasable connection with the reinforcing layers at the inlet port.

8. The enclosure of claim 7 wherein:

the first conduit end is tubular and said releasable connection is a coaxial slip fit of the conduit end and the reinforcing layers.

9. The enclosure of claim 7 wherein:

the conduit is a flexible corrugated hose.

10. The apparatus of claim 1 wherein:

said moist air source includes a household vaporizing device and a means forming a passageway for the moist air from the vaporizing device to the chamber.

11. The enclosure of claim 11 wherein:

the means for forming a passageway includes a flexible conduit having a first conduit end releasably connected with respect to the sheet, and a second conduit end connected with respect to the vaporizing device.

12. The enclosure of claim 11 further including:

an adapter mounted to the vaporizing device and surrounding a moist air output of the vaporizing device, said second conduit end joined to the adapter in a releasable connection.

13. The enclosure of claim 1 wherein:

the frame means include first and second arched frame members having respective ends near the horizontal surface and intersecting one another at respective midportions remote from the horizontal surface to support the sheet in a dome configuration over the horizontal surface.

14. The enclosure of claim 13 wherein:

the frame members are disposed outside of the chamber.

15. A treatment system for providing a high relative humidity environment for a patient, including:

a moist air source for generating moist air including multiple moisture droplets suspended in the air;

a flexible and pliable sheet formed of a porous woven fabric, having a porosity of at least forty percent with individual pores of the fabric being substantially larger than the moisture droplets, whereby the droplets and air pass freely through the sheet while at least a substantial proportion of the moisture droplets suspended in the air is prevented from passing through the sheet;

a frame means positionable on a substantially horizontal surface for supporting the flexible and pliable sheet with respect to the horizontal surface, with the sheet and the surface cooperating to form a chamber for accommodating at least the head and neck region of an individual reclining on the horizontal surface;

a means forming an inlet port in the sheet for receiving the moist air containing droplets into the chamber; and a means forming a passageway for the moist air from the moist air source to the inlet port.

16. The system of claim 15 wherein:

the porous woven fabric is a tricot of a polymeric material.

17. The system of claim 16 wherein:

the tricot forms multiple pores having length and width dimensions in the range of from about one mil to about ten mils.

18. The system of claim 15 wherein:

the porous woven fabric has a porosity in the range of from about forty percent to about sixty percent.

19. The system of claim 18 wherein:

said porosity is about fifty percent.

20. The system of claim 15 wherein:

the means defining a passageway includes a flexible conduit having first and second tubular conduit end portions, the first conduit end is releasably coupled with respect to the inlet port, and the second conduit end is releasably coupled with respect to the moist air source, said moist air source comprising a household vaporizing device.

21. The system of claim 20 further including:

a first reinforcing layer fixed to a portion of the sheet and surrounding the inlet port, a second reinforcing layer attached to the sheet on the opposite side from the reinforcing layer and surrounding the inlet port, and an adapter mounted to the vaporizing device and surrounding a moist air output of the vaporizing device, wherein the first and second conduit ends form respective releasable connections with the reinforcing layers and the adapter.

22. A humidity retaining patient enclosure for use with moist air source, including:

a flexible, pliable and substantially transparent sheet of woven fabric, allowing free passage of air through the sheet, said sheet having a porosity in the range of from about forty percent to about sixty percent, said sheet including multiple pores having length and width dimensions in the range of from about one mil to about ten mils;

a frame means positionable with respect to a substantially horizontal surface to support the sheet with respect to the horizontal surface in a region about the upper body of a patient reclining on the horizontal surface, said sheet and horizontal surface cooperating to form a chamber, with at least the upper body of the patient being within the chamber; and means forming a moisture inlet port in the sheet for receiving moist air into the chamber from a moist air source.

23. The enclosure of claim 22 wherein:

the fabric is a tricot of either a polyimide or a polyester.

24. The enclosure of claim 22 wherein:

the frame means includes first and second arched frame members having respective frame ends supported by the horizontal surface and intersecting one another at respective midportions remote from the horizontal surface to support the sheet in a dome configuration over the upper body of the patient and the horizontal surface.

25. The enclosure of claim 22 further including:

a plurality of loops attached to the sheet and surrounding the first and second arched frame members, said frame members being outside of the chamber.

* * * * *